US006006356A

United States Patent [19]

Song

[11] Patent Number: 6,006,356

[45] Date of Patent: Dec. 28, 1999

[54] WRAPAROUND GARMENT

[76] Inventor: Kevin K. Song, 16174 Elza Dr., Hacienda Heights, Calif. 91745

[21] Appl. No.: 09/220,626

[22] Filed: Dec. 24, 1998

[51] Int. Cl.[6] ..... A41B 1/12; A41B 9/00; A41D 1/12; A41D 1/04

[52] U.S. Cl. ..... 2/69; 2/114; 2/102

[58] Field of Search ..... 2/69, 88, 114, 2/121, 83, 104, 102; 128/869, 873, 874

[56] References Cited

U.S. PATENT DOCUMENTS

| | | | |
|---|---|---|---|
| 156,360 | 10/1874 | Levy . | |
| 1,542,622 | 2/1925 | Luck . | |
| 1,825,520 | 9/1931 | Grünfeld . | |
| 2,331,962 | 10/1943 | Collins . | |
| 2,436,060 | 2/1948 | Trokie et al. . | |
| 3,155,984 | 11/1964 | Derrick . | |
| 3,571,810 | 3/1971 | Swett . | |
| 4,773,102 | 9/1988 | Curtis et al. | 2/93 |
| 4,819,275 | 4/1989 | Lunt | 2/114 |
| 4,987,612 | 1/1991 | Middleton | 2/104 |
| 5,182,813 | 2/1993 | Booze . | |
| 5,564,123 | 10/1996 | Grassick | 2/69 |
| 5,657,489 | 8/1997 | Ponstein . | |

*Primary Examiner*—John J. Calvert
*Assistant Examiner*—Shirra L. Jenkins
*Attorney, Agent, or Firm*—John K. Park; Law Offices of John K. Park & Associates

[57] ABSTRACT

A garment having an elongated body of sheet material having a length at least equal to the length of a wearer's upper torso, and a width at least twice the width of said torso, the garment body including three arm receiving openings arranged longitudinally thereon, said openings including a center opening approximately on the transverse center at substantially a midpoint of the width of the garment body, and two side openings each to one side of the center opening, said three openings being separated by a distance approximately equal to the width of said torso.

11 Claims, 5 Drawing Sheets

WRAPAROUND GARMENT

BACKGROUND

The present invention relates to a garment and in particular to a wraparound type garment.

Wraparound garments can be worn for a variety of purposes including warmth, comfort and style. However, existing wraparound garments either do not provide proper coverage of the wearer's body, or require substantial effort to wear and are not comfortable. In U.S. Pat. No. 2,331,962 issued to H. H. Collins, there is disclosed a garment having rear panel, and extending from the respective side edges thereof, two front panels each of which is wider at bottom than the top. When the front panels are in position on the body of the wearer, they overlap to form a front covering of double thickness. However, the garment requires straps for securing the garment around the wearer's body. As such, the wearer must first wear the garment, and then uses straps attached to the garment, or a separate strap, to tighten the garment around the wearer's body.

In U.S. Pat. No. 3,571,810 issued to Swett et al, there is disclosed a wraparound garment formed from a strip of sheet material having spaced center openings for receiving a wearer's thighs and an opening at each end for insertion of the wearer's head and one arm therethrough. A strap must be used to maintain the garment around the wearer's body. However, the garment requires substantial effort to wear, it is uncomfortable when worn and requires a strap to keep it maintained around the wearer.

There is therefore, a need for a wraparound garment which is simple to manufacture and wear and provides comfort and warmth with flexibility.

SUMMARY

The present invention satisfies these needs. In one embodiment, the present invention provides a garment comprising an elongated body of sheet material having a length at least one half of the length of a wearer's upper torso, and a width at least twice the width of said torso. The garment body includes three arm receiving openings arranged longitudinally thereon, the openings including a center opening approximately on the transverse center at substantially a midpoint of the width of the garment body, and two side openings each to one side of the center opening, said three openings being separated by a distance approximately equal to the width of said torso.

The garment can be worn, for example, by: (1) inserting a first arm in said center opening and inserting a second arm in a first of said side openings such that a portion of the back of the wearer's torso is covered by a first portion of said garment body extending between the center opening and said first side opening; and (2) inserting the second arm into the second of said side openings such that a portion of the front of the wearer's torso is covered by a second portion of said garment body extending between the center opening and said second side opening.

The garment can further include: (1) a sleeve attached to the center opening for receiving one of the wearer's arms therethrough, (2) a sleeve attached to a side opening for receiving one of the wearer's arms therethrough, (3) a first sleeve attached to the center opening for receiving one of the wearer's arms therethrough, and a second sleeve attached to a side opening for receiving another of the wearer's arms therethrough, or (4) first sleeve attached to the center opening for receiving one of the wearer's arms therethrough, a second sleeve attached to a side opening for receiving a wearer's arms therethrough, and a third sleeve attached to another side opening for receiving a wearer's arms therethrough.

DRAWINGS

These and other features, aspects and advantages of the present invention will become better understood with regard to the following description, appended claims and accompanying drawings where:

DESCRIPTION

Figure 1:
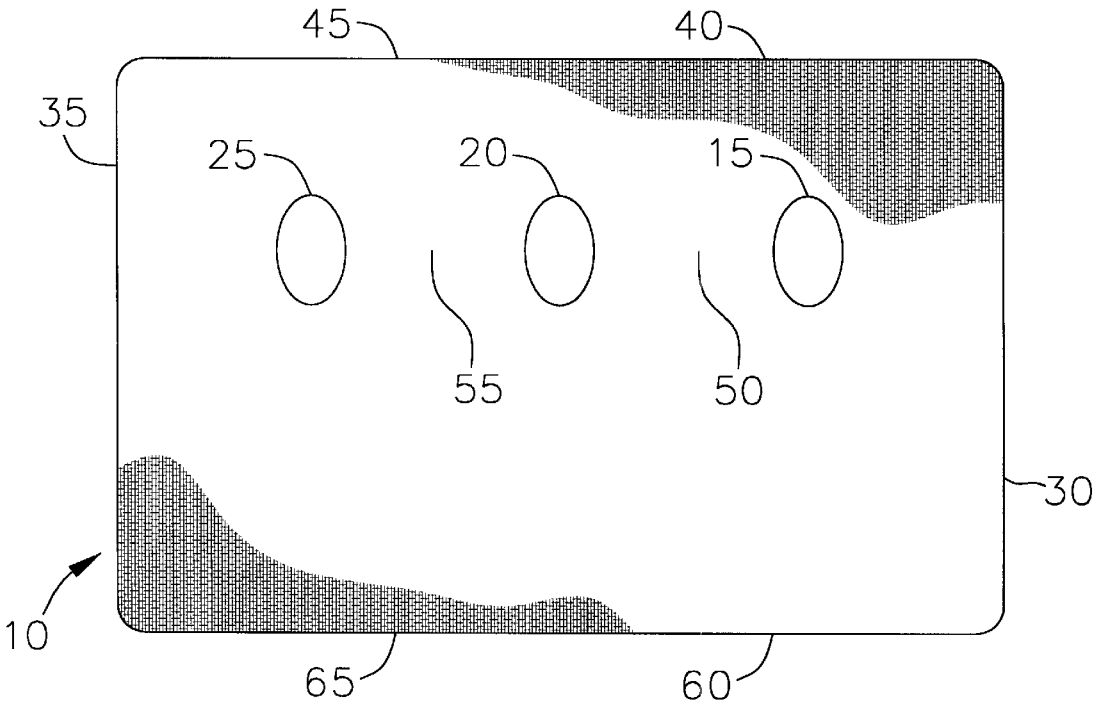
FIG. 1 is a plan view of an embodiment of a garment according to the present invention.

Referring to FIG. 1, in ore embodiment, the present invention provides a garment comprising an elongated body 10 of sheet material having a length at least one half of the length of a wearer's upper torso, and a width at least twice the width of said torso. The garment body 10 includes three arm receiving openings as a center opening 20, a side opening 15 and another side opening 25 arranged longitudinally thereon. The center opening 20 is approximately on the transverse center at substantially a midpoint of the width of the garment body 10, and the side openings 25, 15 are each to one side the center opening 20. The openings 15 and 20 are separated by a distance approximately equal to the width of said torso, and the openings 20 and 25 are separated by a distance approximately equal to the width of said torso.

Figure 4:
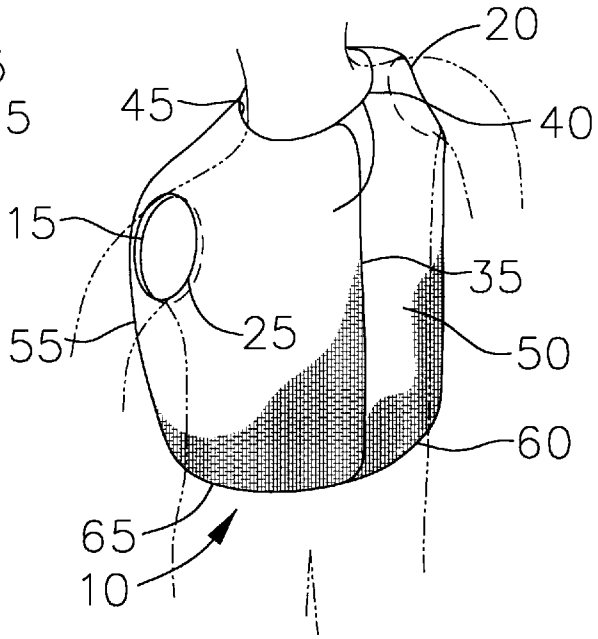
FIG. 4 is a rear, elevational view showing the garment of FIG. 3 wrapped around the wearer.
Figure 3:
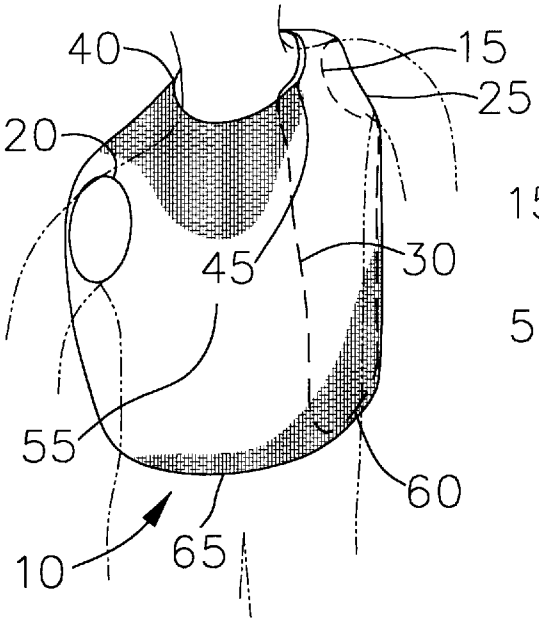
FIG. 3 is another front, elevational view showing the garment of FIG. 2 wrapped around the wearer.
Figure 2:
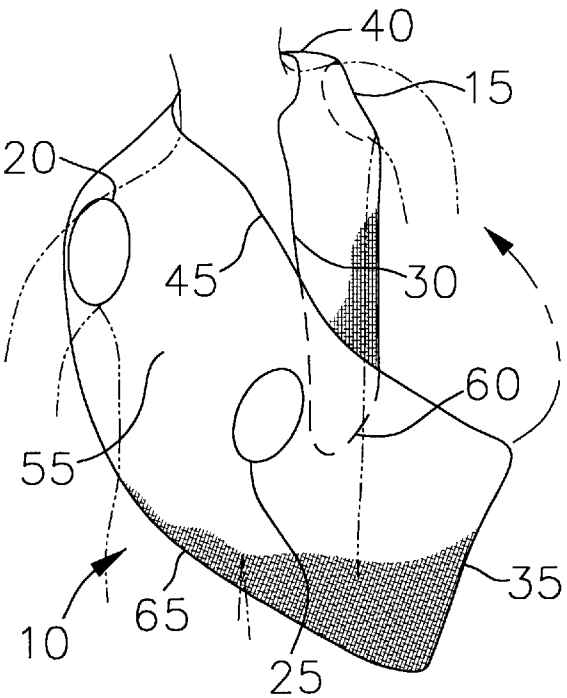
FIG. 2 is a front, elevational view showing the garment of FIG. 1 in position on a wearer in readiness for being wraparound the wearer.

FIGS. 2–4 show an example method of wearing the garment by a wearer. The wearer inserts a first arm in said center opening 20 and then inserts a second arm in the side opening 15 such that a portion of the back of the wearer's torso is covered by a first portion 50 of said garment body 10 extending between the center opening 20 and the side opening 15. The wearer then wraps the garment body 10 around the front body torso and over a first edge 30 of the garment body 10, and then inserts the second arm into the side opening 25 such that a portion of the front of the wearer's torso is covered by a second portion 55 of said garment body 10 extending between the center opening 20 and the side opening 25. A second edge 35 of the garment body extends over a part of the wearer's back.

The garment body 10 can further comprise an upper edge having a collar 40 corresponding to at least a portion of the back of the wearers' neck. The collar 40 is arranged on said upper edge longitudinally and is of a length corresponding to the distance between the center opening 20 and the side opening 15 on the garment body 10. In that case, the portion 50 of the garment body 10 corresponds to the back of the wearer's torso, and the portion 55 of the garment body 10 corresponds to the front of the wearer's torso. Alternatively, said upper edge can have a have a collar 45 corresponding to at least the back of the wearers' neck. The collar 45 being arranged on said upper edge longitudinally and is of a length corresponding to the distance between the center opening 20 and the side opening 25 on the garment body 10. In that case, the portion 55 of the garment body 10 corresponds to the back of the wearer's torso, and the portion 50 of the garment body 10 corresponds to the front of the wearer's torso. The collar portions 40, 45 can further be shaped according to the shape of the collar and shoulder portions of a desired style such as jacket, a raincoat, or other styles.

Figure 5:
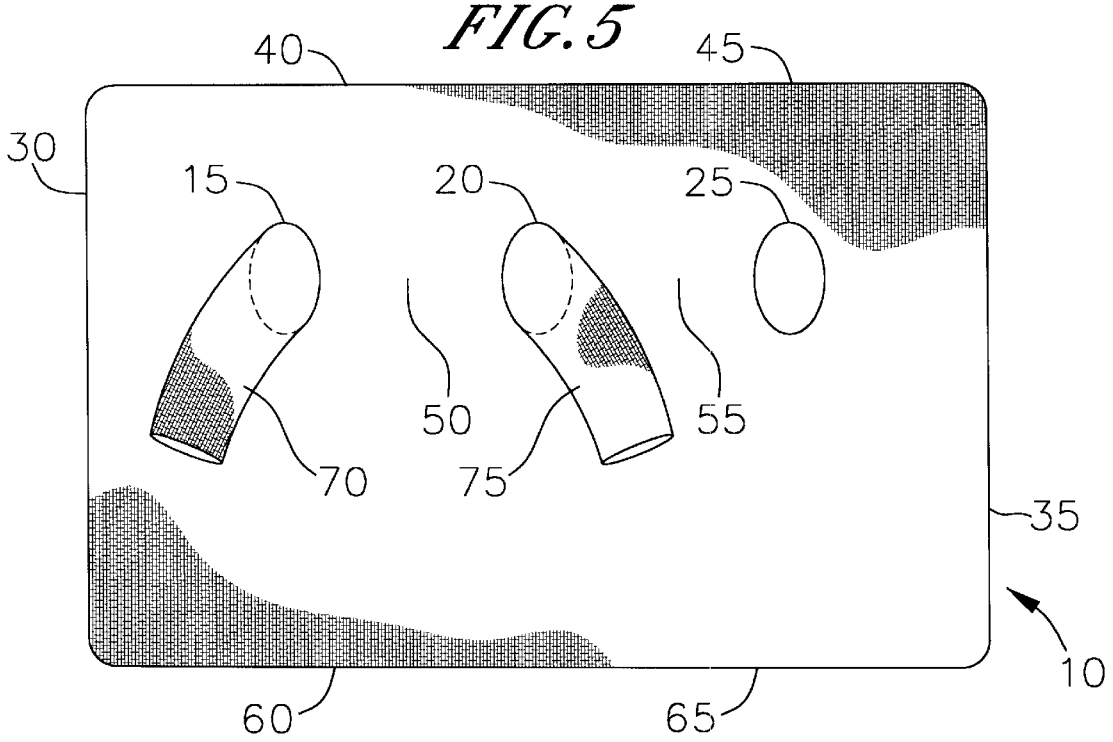
FIG. 5 is a rear plan view of another embodiment of a garment according to the present invention showing two sleeves.
Figure 6:
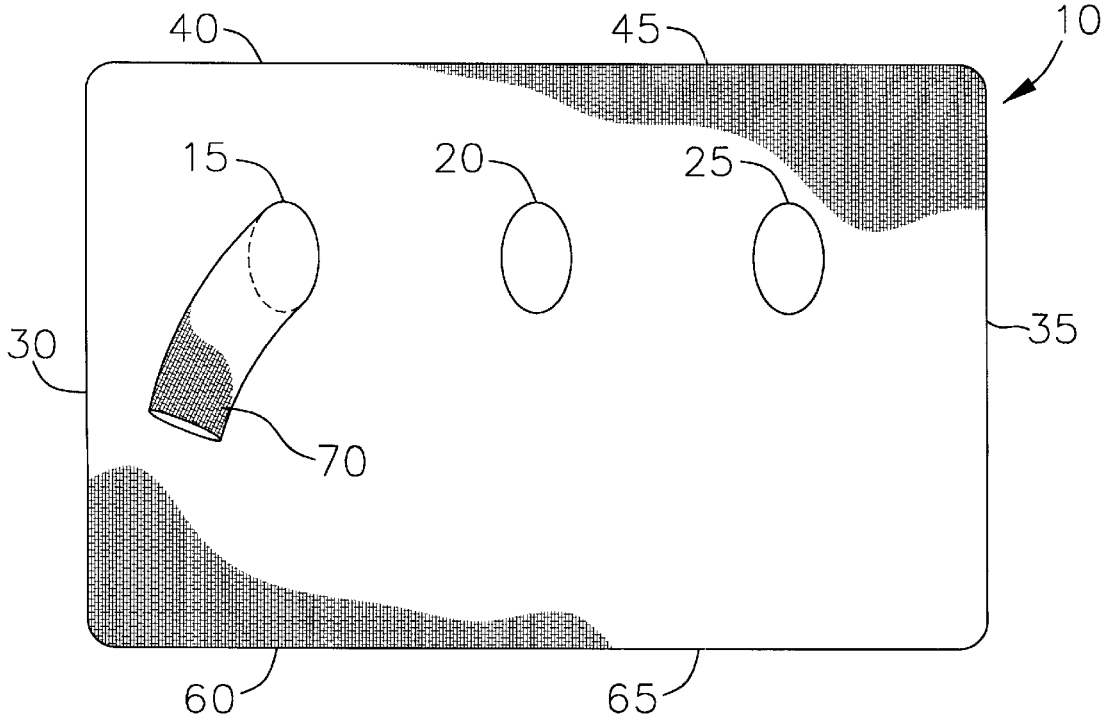
FIG. 6 is a rear plan view of another embodiment of a garment according to the present invention showing one sleeve.
Figure 7:
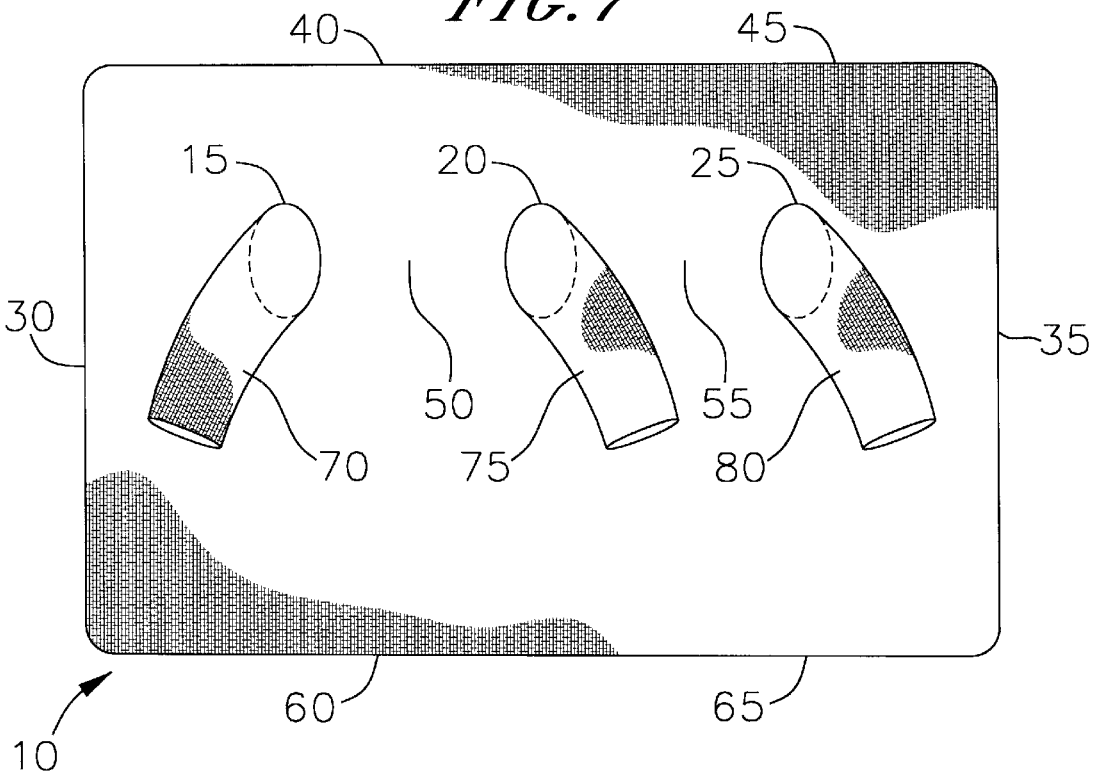
FIG. 7 is a rear plan view of another embodiment of a garment according to the present invention showing three sleeves.

FIGS. 5–7 are plan views of the back of the garment body 10. Referring to FIG. 5, in an example embodiment, the garment 10 includes a first sleeve 75 attached to the center opening 20 for receiving one of the wearer's arms therethrough, and a second sleeve 70 attached to the side opening 15 for receiving another of the wearer's arms therethrough. Referring to FIG. 6, in another example embodiment, the garment body 10 can have a sleeve 70 attached to the side opening 15 for receiving one of the wearer's arms therethrough. Referring to FIG. 7, in another example, the garment body 10 can have a first sleeve 75 attached to the center opening 20, a second sleeve 70 attached to the side opening 15, and a third sleeve 80 attached to the side opening 25 for receiving a wearer's arms therethrough.

Figure 8:
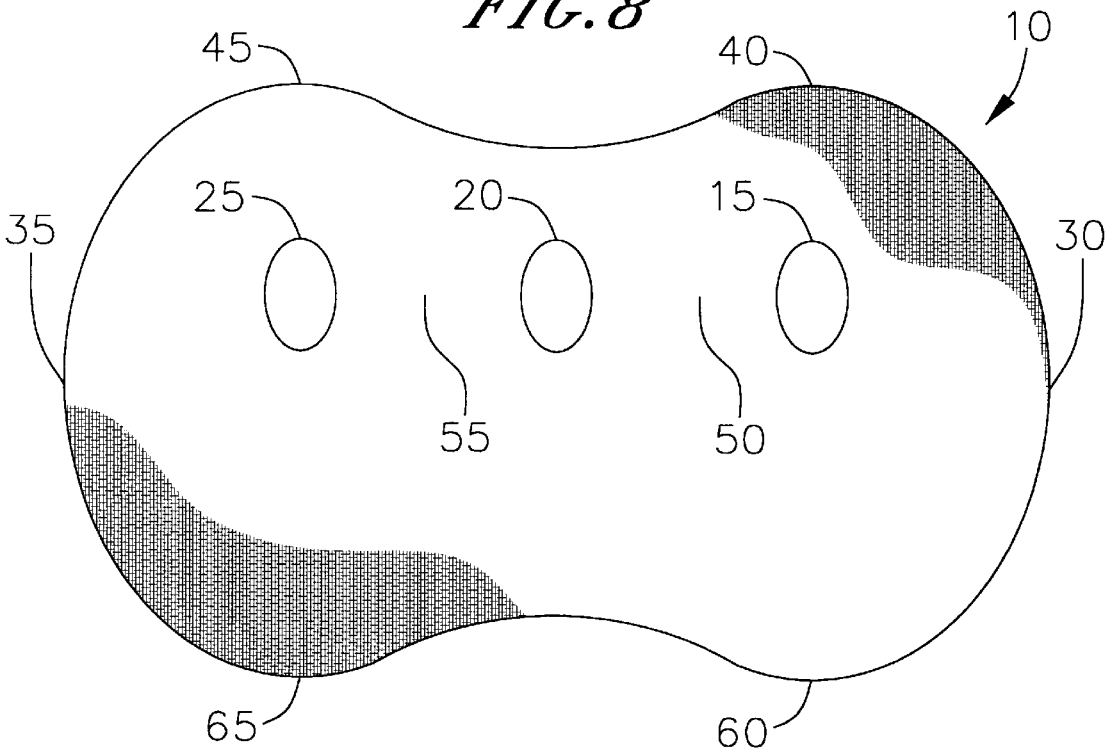
FIG. 8 is a plan view of another embodiment of a garment having bow-tie according to the present invention.
Figure 9:
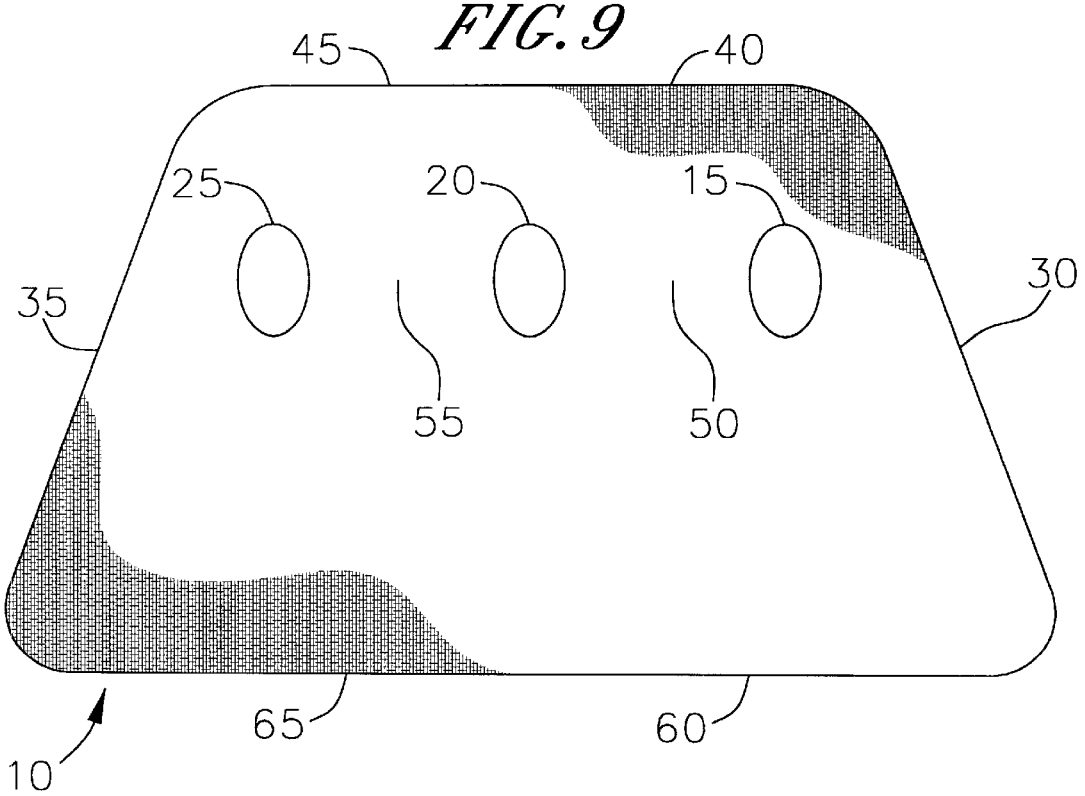
FIG. 9 is a plan view of another embodiment of a garment having a tapered shape according to the present invention.
Figure 10:
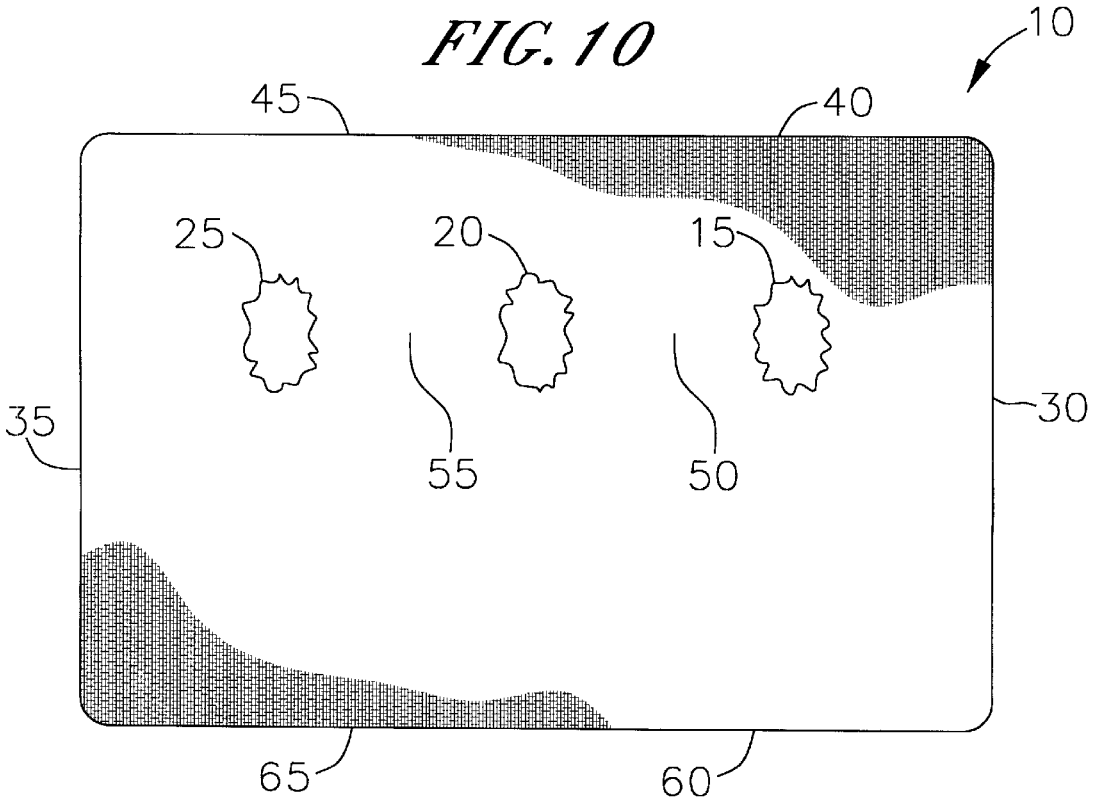
FIG. 10 is a plan view of another embodiment of a garment according to the present invention.

As shown in FIGS. 1–7, the garment body 10 has a substantially rectangular shape, however other shapes are possible. For example, the garment body 10 can have a bow-tie shape as shown in FIG. 8, or a tapered shape as shown in FIG. 9. In one version, the length of the garment body 10 can be at least equal to the length of said torso, such that lower edges 60 and 65 of the garment body 10 reach to about the wearer's waist. In another version, the length of the garment body 10 can be at least equal to the distance from the wearer's shoulders to the wearer's knees when the wearer is standing erect. Yet in another embodiment, the width of the garment body 10 can be approximately three times the width of said torso. Further, one or more of the openings 15, 20 and 25 can be shaped as slits arranged along the transverse axis of the garment body, or have desired cutout edges such as shown in FIG. 10. The portion of the garment body 10 extending from the side opening 15 to side edge 30 can be selected to be of a width to cover at least a portion of the front of the torso of the wearer when the garment 10 is worn. Similarly, The portion of the garment body 10 extending from the side opening 25 to side edge 35 can be selected to be of a width to cover at least a portion of the back of the torso of the wearer when the garment 10 is worn.

The garment 10 can be of natural or synthetic materials. The garment 10 can also be made from several pieces of sheet material, each of the same or different materials. Similarly, the sleeves can be made of natural or synthetic materials. The garment 10 can also include a lining and be layered. Further, the garment body can include attachment means such as buttons or straps alone one or more of the edges 30, 35 and corresponding portions 55, 50, respectively, for further securing the garment 10 to the body. The openings 15, 20 and 35 can have reinforced edges to longevity and comfort. The garment 10 can also include external or internal pockets attached thereto to for storage of various items.

Although the present invention has been described in considerable detail with regard to the preferred versions thereof, other versions are possible. Therefore, the appended claims should not be limited to the descriptions of the preferred versions contained herein.

What is claimed is:

1. A garment comprising an elongated body of sheet material having a length at least about one half of the length of a wearer's upper torso, and a width at least twice the width of said torso, the garment body including three arm receiving openings arranged longitudinally thereon, said openings including a center opening approximately on the transverse center at substantially a midpoint of the width of the garment body, and two side openings each to one side of the center opening, said three openings being separated by a distance approximately equal to the width of said torso.

2. The garment of claim 1 further comprising a sleeve attached to the center opening for receiving one of the wearer's arms therethrough.

3. The garment of claim 1 further comprising a sleeve attached to a side opening for receiving one of the wearer's arms therethrough.

4. The garment of claim 1 further comprising a first sleeve attached to the center opening for receiving one of the wearer's arms therethrough, and a second sleeve attached to a side opening for receiving another of the wearer's arms therethrough.

5. The garment of claim 1 further comprising: (a) first sleeve attached to the center opening for receiving one of the wearer's arms therethrough, (b) a second sleeve attached to a side opening for receiving a wearer's arms therethrough, and (c) a third sleeve attached to another side opening for receiving a wearer's arms therethrough.

6. The garment of claim 1 wherein one or more of the openings are shaped as slits arranged along the transverse axis of the garment body.

7. The garment of claim 1 wherein the garment body further comprises an upper edge having a collar corresponding to at least a portion of the back of the wearers' neck, said collar portion being arranged on said upper edge longitudinally and of a length corresponding to the distance between the center opening and a side opening on the garment body.

8. The garment of claim 1, wherein the garment body is substantially rectangular in shape.

9. The garment of claim 1, wherein the length of the garment body is at least equal to the length of said torso.

10. The garment of claim 1, wherein the length of the garment body is at least equal to the distance from the wearer's shoulders to the wearer's knees when the wearer is standing erect.

11. The garment of claim 1, wherein the width of the garment body is approximately three times the width of said torso.

* * * * *